US010265558B2

(12) United States Patent
Smith et al.

(10) Patent No.: US 10,265,558 B2
(45) Date of Patent: Apr. 23, 2019

(54) PYROTECHNIC VALVE

(71) Applicant: Kidde Graviner Limited, Slough, Berkshire (GB)

(72) Inventors: Paul D. Smith, Camberley (GB); Robert G. Dunster, Slough (GB)

(73) Assignee: KIDDE GRAVINER LIMITED, Slough, Berkshire (GB)

( * ) Notice: Subject to any disclaimer, the term of this patent is extended or adjusted under 35 U.S.C. 154(b) by 66 days.

(21) Appl. No.: 15/099,650

(22) Filed: Apr. 15, 2016

(65) Prior Publication Data

US 2016/0303409 A1 Oct. 20, 2016

(30) Foreign Application Priority Data

Apr. 17, 2015 (GB) ..... 1506552.7

(51) Int. Cl.
*A62C 13/00* (2006.01)
*A62C 13/64* (2006.01)
(Continued)

(52) U.S. Cl.
CPC ..... *A62C 13/64* (2013.01); *A62C 13/003* (2013.01); *A62C 13/006* (2013.01); *A62C 35/08* (2013.01);
(Continued)

(58) Field of Classification Search
CPC ..... A62C 35/00; A62C 35/08; A62C 13/006; A62C 19/00; A62C 37/28; F16K 17/16; F16K 13/06
(Continued)

(56) References Cited

U.S. PATENT DOCUMENTS 1,588,233 A * 6/1926 Kauch ..... A62C 13/22 169/84
3,191,533 A * 6/1965 Hopson, III ..... F16K 13/06 102/306
(Continued)

FOREIGN PATENT DOCUMENTS

CN 103591357 A 2/2014
EP 0289571 A1 11/1988
(Continued)

OTHER PUBLICATIONS

Extended European Search Report for International Application No. 16165639.2 dated Aug. 22, 2016, 9 pages.
(Continued)

*Primary Examiner* — Viet Le
(74) *Attorney, Agent, or Firm* — Cantor Colburn LLP

(57) ABSTRACT

There is provided a valve for controlling the release of fire suppressant from a pressurized container, said valve comprising a diaphragm configured to perforate upon action of a shockwave directed onto the surface of said diaphragm, a pyrotechnic charge arranged and adapted to combust to produce combustion products that form a shockwave directed onto the surface of said diaphragm, and a device encasing said pyrotechnic charge. The device comprises a hollow, elongate channel located over said pyrotechnic charge and directed at the center of said diaphragm so as to focus or direct said combustion products onto the center of said diaphragm. The elongate channel has a length that is at least 1.5 times its smallest width.

10 Claims, 4 Drawing Sheets

(51) Int. Cl.
*A62C 35/08* (2006.01)
*A62C 35/13* (2006.01)
*A62C 37/46* (2006.01)
*A62C 13/62* (2006.01)

(52) U.S. Cl.
CPC ..... *A62C 35/13* (2013.01); *A62C 37/46* (2013.01); *A62C 13/62* (2013.01)

(58) Field of Classification Search
USPC ..... 169/26, 77, 28, 12, 19, 84; 137/68.13, 137/68.22, 68.23
See application file for complete search history.

(56) References Cited

U.S. PATENT DOCUMENTS 4,084,602 A 4/1978 Cook
4,158,322 A * 6/1979 Hardesty ..... F15B 15/19 89/1.14
4,319,640 A * 3/1982 Brobeil ..... A62C 35/02 169/28
4,664,033 A * 5/1987 Burkdoll ..... C06C 7/00 102/275.11
4,760,886 A * 8/1988 Sassier ..... A62C 35/08 169/28
5,449,027 A * 9/1995 Mueller ..... B65B 55/022 141/10
5,536,990 A * 7/1996 Nelson ..... F42C 11/02 102/210
5,673,933 A * 10/1997 Miller ..... B60R 21/272 220/361
5,782,486 A * 7/1998 Barnes ..... B60N 2/002 137/68.13
5,820,162 A * 10/1998 Fink ..... B60R 21/205 280/742
5,984,351 A * 11/1999 Pierotti ..... B60R 21/268 102/531
5,992,528 A * 11/1999 Parkinson ..... A62C 13/22 169/26
6,010,153 A * 1/2000 Halas ..... B60R 21/272 137/68.13
6,338,500 B1 * 1/2002 Perotto ..... B60R 21/272 280/741
6,371,213 B1 * 4/2002 Smith ..... A62C 3/0292 169/33
6,490,978 B1 * 12/2002 Perotto ..... B60R 21/2644 102/531
6,578,487 B2 * 6/2003 Avetisian ..... F42B 3/125 102/202.5
6,612,243 B1 * 9/2003 Italiane ..... A62C 13/22 102/367
6,644,206 B2 * 11/2003 Fogle, Jr. ..... B60R 21/2644 102/530
6,662,702 B1 * 12/2003 Vidot ..... B60T 7/065 102/530
6,676,157 B2 * 1/2004 Nanbu ..... B60R 21/268 280/736
6,702,033 B1 * 3/2004 Mitchell ..... A62C 35/023 169/85
6,709,011 B2 * 3/2004 Neunzert ..... B60R 21/2644 280/736
6,848,365 B2 * 2/2005 Avetisian ..... F42B 3/195 102/202.5
6,857,657 B2 * 2/2005 Canterberry ..... B60R 21/272 280/737
6,979,021 B2 * 12/2005 Young ..... B60R 21/268 280/737
7,172,031 B2 * 2/2007 Piatti ..... A62C 3/07 169/56
7,316,187 B2 * 1/2008 Hansen ..... F42B 3/127 102/530
7,338,073 B2 * 3/2008 Nakayasu ..... B60R 21/268 280/737
7,559,376 B2 * 7/2009 Silva, Jr. ..... A62C 37/14 169/17
7,588,265 B2 * 9/2009 Blackburn ..... B60R 21/268 280/737
8,136,452 B2 * 3/2012 Asanuma ..... B60R 21/272 102/530
8,205,631 B2 * 6/2012 Schramm ..... F16K 17/1613 137/68.3
8,720,946 B2 * 5/2014 Prima ..... B60R 21/2644 102/530
8,915,307 B2 * 12/2014 Lelic ..... A62C 31/05 169/37
8,960,095 B2 * 2/2015 Peremarty ..... B60R 21/274 102/530
9,003,975 B2 * 4/2015 Aoyagi ..... B60R 21/2644 102/530
9,352,177 B2 * 5/2016 Smith ..... A62C 37/48
9,731,680 B2 * 8/2017 Kobayashi ..... B60R 21/268
2002/0007755 A1 * 1/2002 Perotto ..... B60R 21/272 102/530
2003/0178349 A1 * 9/2003 Bacon ..... B01D 35/02 210/94
2004/0194974 A1 * 10/2004 Arnot ..... A62C 13/22 169/30
2004/0216903 A1 * 11/2004 Wierenga ..... A62C 35/023 169/85
2012/0037717 A1 * 2/2012 Zakhmatov ..... A62C 3/0242 239/1
2012/0273240 A1 * 11/2012 Smith ..... A62C 37/48 169/70
2012/0279732 A1 * 11/2012 Smith ..... A62C 37/36 169/61
2013/0118765 A1 * 5/2013 Smith ..... A62C 37/36 169/61
2014/0008308 A1 * 1/2014 Guy ..... B01D 29/111 210/767
2014/0216767 A1 * 8/2014 Qiang ..... A62C 13/76 169/28
2014/0263030 A1 * 9/2014 Weller ..... A62C 35/08 210/432
2015/0165251 A1 * 6/2015 Marlin ..... A62C 35/023 169/61
2017/0232282 A1 * 8/2017 Lee ..... A62C 5/006 169/28

FOREIGN PATENT DOCUMENTS

EP 0979125 A1 2/2000
GB 2171905 A 9/1986
WO 2014001722 A1 1/2014

OTHER PUBLICATIONS

GB Search Report; Application No. GB1506552.7, dated Oct. 27, 2015; 6 pages.

* cited by examiner

PYROTECHNIC VALVE

FOREIGN PRIORITY

This application claims priority to Great Britain Application No. 1506552.7 filed on Apr. 17, 2015, the entire contents of which is incorporated herein by reference.

TECHNICAL FIELD

The present disclosure relates to a valve for controlling the release of fire suppressant from a chamber.

BACKGROUND TO THE PRESENT DISCLOSURE

Fire suppressant, in particular powder fire suppressant, is typically held in a pressurised container until such time that it is required to be deployed into an environment. A valve may be placed at an outlet of the container to prevent premature deployment of the suppressant, which valve may be activated by use of a pyrotechnic charge as discussed below. An example of such a container and valve arrangement is shown in FIGS. 1A-1C.

FIG. 1A shows a container 10 for holding a fire suppressant at a raised pressure, and a valve 20 for controlling the release of the fire suppressant into an external environment, such as a fire suppressant system (not shown).

FIG. 1B shows a cross-section of the container 10 and valve 20 through line A-A in FIG. 1. The operative orientation of the container is such that the valve 20 is located at the bottom of the container in use. Thus, it can be seen that in operation the fire suppressant 1 is held within the container and rests on the valve 20 due to gravity.

FIG. 1C shows a close up of the valve 20 (indicated at "B" in FIG. 1B) which comprises a hollow valve body 22 that is located inside an outlet 12 of the container 10. A rupturable diaphragm 30 is located within the valve body 22 and acts to seal the container 10 to prevent pressurised fire suppressant from escaping prematurely.

A pyrotechnic charge 40 is located inside the valve 20 and below the diaphragm 30. Upon actuation of the pyrotechnic charge 40 a shockwave or localised blast is directed onto the centre of the diaphragm 30. This shockwave causes flexure of the diaphragm 30 inwards towards the fire suppressant 1. This causes mechanical weakening of the diaphragm 30 causing the diaphragm 30 to rupture or perforate (e.g. burst open, tear) and open outwards away from the fire suppressant 1.

Once the diaphragm 30 is perforated fire suppressant expels out through the outlet 12 and valve 20 and into the external environment to perform its fire suppressing function, due to the pressure differential initially present between the interior of the container 10 and the environment.

The present disclosure is aimed at improving the ability of the diaphragm to open to ensure that the fire suppressant can be deployed.

SUMMARY OF THE PRESENT DISCLOSURE

In accordance with an aspect of the disclosure, there is provided a valve for controlling the release of fire suppressant from a pressurised container, the valve comprising: a diaphragm configured to perforate upon action of a shockwave directed onto the surface of the diaphragm; a pyrotechnic charge arranged and adapted to combust to produce combustion products that form a shockwave directed onto the surface of the diaphragm; and a device encasing the pyrotechnic charge and comprising a hollow, elongate channel located over the pyrotechnic charge and directed at the centre of the diaphragm so as to focus or direct the combustion products onto the centre of the diaphragm. In this aspect, the elongate channel has a length that is at least 1.5 times a width, for example the smallest width, of the channel.

Provision of such an elongate channel focuses combustion products onto the centre of the diaphragm, and increases the energy applied to the diaphragm by the combustion products. This makes better use of the pyrotechnic charge and also decreases the energy lost to the environment.

The elongate channel may extend from an end of the charge towards the diaphragm, and may comprise the only passage for combustion products to be released or expelled upon activation (i.e. combustion) of said pyrotechnic charge. The elongate channel may be cylindrical or frusto-conical. The width of the elongate channel may be uniform or irregular. For example, the elongate channel may taper towards or away from the pyrotechnic charge, or towards or away from the diaphragm. The width of the channel referred to above may be the smallest or largest width of the channel. The smallest width of the elongate channel may be located at the end of the channel located towards the diaphragm.

The elongate channel may have a length that is at least 2, 3, 4 or 5 times a width, for example the smallest width, of the elongate channel.

The device may comprise a lower portion comprising a relatively large inner diameter and holding the pyrotechnic charge. The device may comprise an upper portion comprising the elongate channel. The elongate channel may comprise a relatively small inner diameter.

The diaphragm may comprise a plurality of score lines that optionally define portions of the diaphragm that will tear open upon action of a shockwave directed onto the surface of the diaphragm. The score lines may have a length that is sufficient (e.g. small enough) to allow portions of the diaphragm to open past the device and/or pyrotechnic charge. The score lines optionally cover the entire diameter, or substantially the entire diameter of the diaphragm. In embodiments in which the diaphragm comprises a dome-shaped, or hemispherical portion, the score lines may cover the entire diameter, or substantially the entire diameter of the dome or hemisphere.

The diaphragm may have a width or diameter, and the width or diameter may be less than, greater than or equal to 35 mm, 30 mm, 25 mm, 20 mm, 10 mm or 5 mm.

The diaphragm may be of the "non-fragmenting" type, in that it may be configured to flex, weaken and perforate upon action of a or the shockwave directed onto its surface.

The valve may further comprise a passage for fire suppressant to travel through. The passage may extend from a valve inlet to a valve outlet. The diaphragm and/or pyrotechnic charge and/or device may be located within the passage.

The pyrotechnic charge may comprise a cap or cover enclosing a combustible material. The cap or cover may be separate to the device encasing the pyrotechnic charge. The device may be located over and/or around the cap or cover, and may encase the cap or cover. The elongate channel may extend from a top of the cap or cover and towards the diaphragm. The cap or cover may be configured to burst open, and optionally without fragmenting, upon activation of the pyrotechnic charge. The cap or cover may be made of a relatively weak material to said device and/or said diaphragm.

The pyrotechnic charge may consist of, or consist essentially of a combustible material, and the device may comprise a cap or cover enclosing the combustible material.

As used herein, "consist essentially of" means that the pyrotechnic charge comprises only a combustible material and further components that do not materially affect the essential characteristics of the pyrotechnic charge. For example, a binder may be present in small amounts to hold the combustible material together.

Optionally, and in any of the embodiments described above, there may be no further material present between the pyrotechnic charge, combustible material, cap or cover and the device.

The device may be configured to stay intact upon activation of the pyrotechnic charge.

The device may be metallic or ceramic, or may comprise a metallic or ceramic material. For example, the interior portions of the device and/or those portions of the device that encase the pyrotechnic charge may be metallic or ceramic, or may comprise a metallic or ceramic material. The elongate channel may be metallic or ceramic, or may comprise a metallic or ceramic material, or may have a metallic or ceramic lining.

The pyrotechnic charge may of configured such that the combustion products comprise primarily gaseous matter. In some embodiments, the pyrotechnic charge may be configured such that the combustion products do not comprise solid fragments, for example of the pyrotechnic charge.

The diaphragm may be located a distance from the pyrotechnic charge, which distance may be <10 mm, <5 mm, or <2 mm. The distance may be sufficient to allow portions of the diaphragm to open past the device and/or pyrotechnic charge. The distance may be sufficient to allow portions of the diaphragm to open at least 45 degrees upon perforation thereof.

The diaphragm may comprise a plurality of score lines that optionally define portions of the diaphragm that will tear open upon action of a shockwave directed onto the surface of the diaphragm. The score lines may have a length that is sufficient (e.g. small enough) to allow portions of the diaphragm to open past the device and/or pyrotechnic charge.

The device may comprise a hollow tube or cylinder having a chamfered end located towards the diaphragm. The device may comprise a flat upper surface (e.g. facing towards the diaphragm), and the upper surface may comprise the chamfered end, for example the outer circumference of the upper surface may be chamfered. The chamfered end may be provided or configured to prevent the portions of the diaphragm touching the tube upon opening.

The diaphragm may be located a distance from the hollow tube such that the portions of the diaphragm would touch the tube if the end of the tube located towards the diaphragm was not chamfered.

The valve, including the diaphragm, pyrotechnic charge and device may be removable and/or replaceable. The valve may comprise an interior passage extending between a valve inlet and a valve outlet, wherein in use fire suppressant is able to flow into the valve inlet, and through the interior passage to the valve outlet. The diaphragm may be located within the interior passage and may act as a seal for preventing passage of fire suppressant from the valve inlet to the valve outlet via the interior passage, prior to its perforation. The diaphragm, pyrotechnic charge and device may all be located within the interior of the valve. The valve, including the diaphragm, pyrotechnic charge and device may comprise a single unit, for example a transferrable unit. The valve may be configured to plug and/or cover and/or seal a chamber for holding a fire suppressant, for example a pressurised container.

In accordance with an aspect of the disclosure, there is provided an apparatus comprising: a chamber for holding fire suppressant and having an outlet; and any valve described herein wherein the valve seals the outlet of the chamber so as to control the release of fire suppressant therefrom.

The apparatus may further comprise fire suppressant, for example fire suppressant powder, within the chamber. The chamber and/or the fire suppressant may be pressurised.

The chamber may be a bottle or cylinder shape, and may comprise a narrowed neck portion comprising the outlet, which may be the only outlet of the chamber. The valve may extend into the outlet and may plug and/or cover and/or seal the chamber.

The apparatus may comprise means for creating a pressure differential across the diaphragm after perforation of said diaphragm.

In accordance with an aspect of the present disclosure, there is provided a method of using a valve or apparatus as described herein, said method comprising: activating or igniting said pyrotechnic charge so as to direct a shockwave onto the surface of said diaphragm.

In accordance with an aspect of the present disclosure, there is provided an apparatus substantially as herein described with reference to the accompanying drawings.

In accordance with an aspect of the present disclosure, there is provided a method of manufacturing a valve or apparatus as described above.

BRIEF DESCRIPTION OF THE DRAWINGS

Various embodiments of the present disclosure will now be described, together with an example given for illustrative purposes only, and by way of example only, and with reference to the accompanying drawings in which.

DETAILED DESCRIPTION OF PREFERRED EMBODIMENT

Figure 1A:
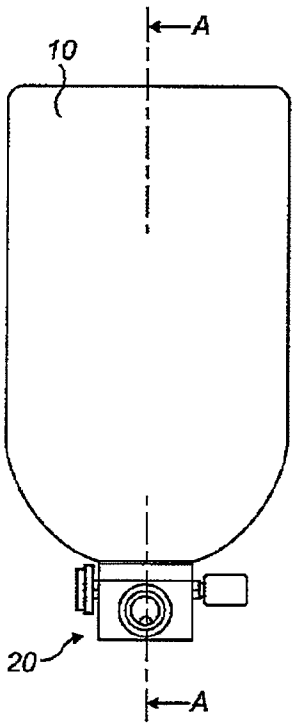
FIG. 1A PRIOR ART
FIGS. 1A-1C show a conventional apparatus comprising a chamber holding a fire suppressant and a valve for controlling release of fire suppressant from the chamber.

An embodiment of the present disclosure will now be described with reference to FIG. 2, which shows an apparatus including a container 100 and a valve 200.

The container 100 is of the type used to hold a fire suppressant (not shown) in its interior, optionally in powder form, and is largely cylindrical, forming a bottle-shape with an outlet 120 (which may be the only outlet) provided at a lower end of the container 100. The container 100 comprises a neck portion 102 and a chamber portion 103. The chamber portion 103 has a maximum diameter that is relatively large when compared to the diameter of the neck portion 102, and forms the main body of the container 100 for holding most of the fire suppressant. The neck portion 102 and the outlet 120 are of a smaller diameter.

The interior of the container is pressurised, for example using nitrogen gas. The valve 200 is inserted into the outlet 120 so as to plug or seal the container 100 and prevent pressurised fire suppressant held within the container from being released prematurely. Other shapes of container may be used, and the disclosure is not limited to cylindrical containers such as the one shown.

The valve 200 comprises a valve body 220 that is hollow and forms a passage 222 for fire suppressant to transfer from the interior of the container 100 to the environment. The passage 222 extends from a valve inlet 223 to a valve outlet 224. The valve inlet 223 and a neck 226 of the valve body 220 fit within the outlet 120 of the container 100, and a shoulder portion 228 of the valve body 220 rests on an exterior surface of the container 100. The valve inlet 223 and neck 226 are sealed against the walls of the neck portion 102 and outlet 120 of the container 100. Any suitable sealing method may be used.

The apparatus includes a rupturable diaphragm 130 that is positioned within the passage 222 of the valve body 220. The diaphragm 130 is sealed against the interior walls of the passage 222 and valve body 220 so as to prevent the fire suppressant from being released through said passage 222.

Figure 4:
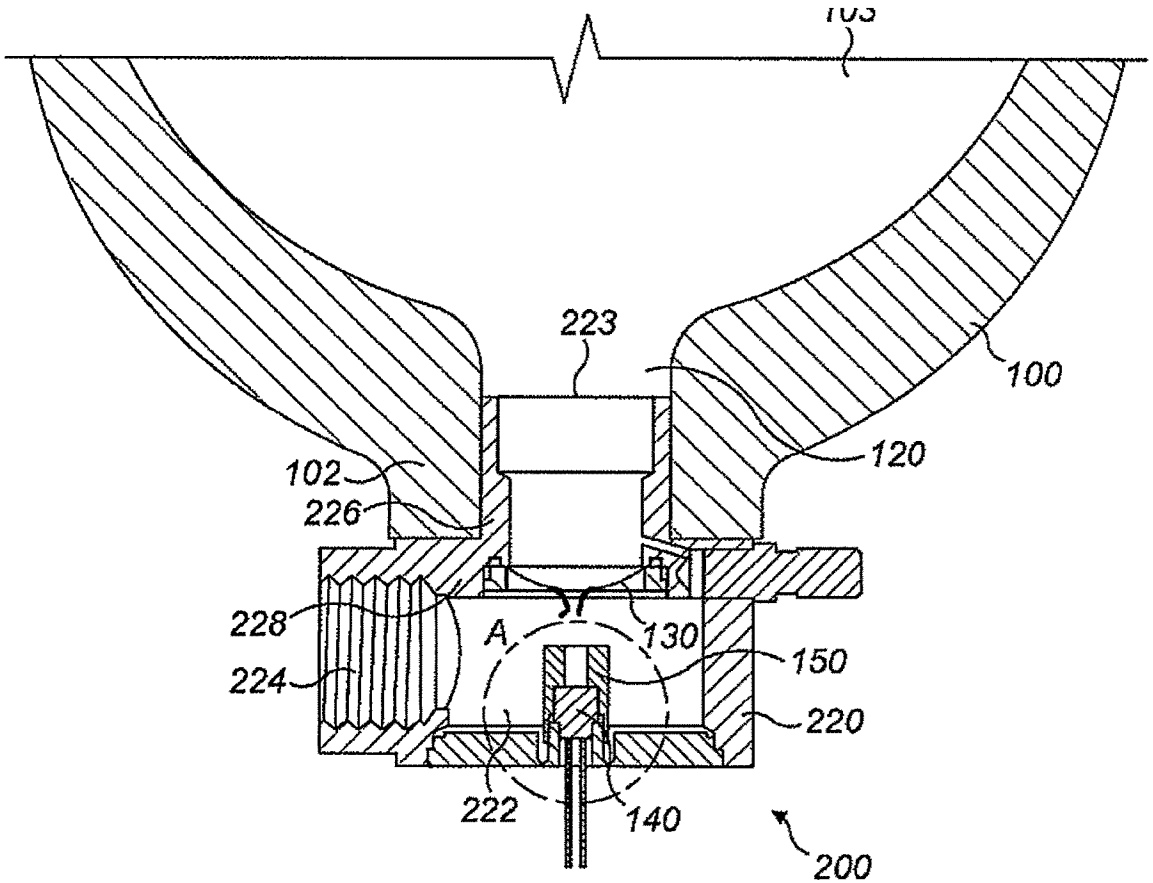
FIG. 4 shows an embodiment of the present disclosure after rupture of the diaphragm.

A pyrotechnic charge 140 is provided and arranged such that, upon activation of the charge, a shockwave, or percussive wave, is directed onto the diaphragm 130 by the rapid release of gas and heat generated by the pyrotechnic charge 140. This kind of charge may be termed a gaseous charge. This causes the diaphragm 130 to flex, weaken and perforate (or burst, fail, tear etc.). Due in part to the pressure differential across the diaphragm 130 when the container 100 is pressurised, the diaphragm 130 perforates outwards away from the chamber portion 103 and fire suppressant as shown in FIG. 4.

This gaseous mechanism is different from, say, an explosive or fragmenting charge that uses fragments of hot metal to perforate a diaphragm. Optionally, the pyrotechnic charge does not expel fragments of metal upon activation. The shockwave is optionally comprised primarily of gaseous matter.

After perforation of the diaphragm 130, fire suppressant transfers from the interior of the container 100 to the external environment (e.g. a fire suppressant system for a building or transport vehicle such as an aircraft) via passage 222. This is due, in part, to the fire suppressant being held under pressure within the container 100.

Figure 5:
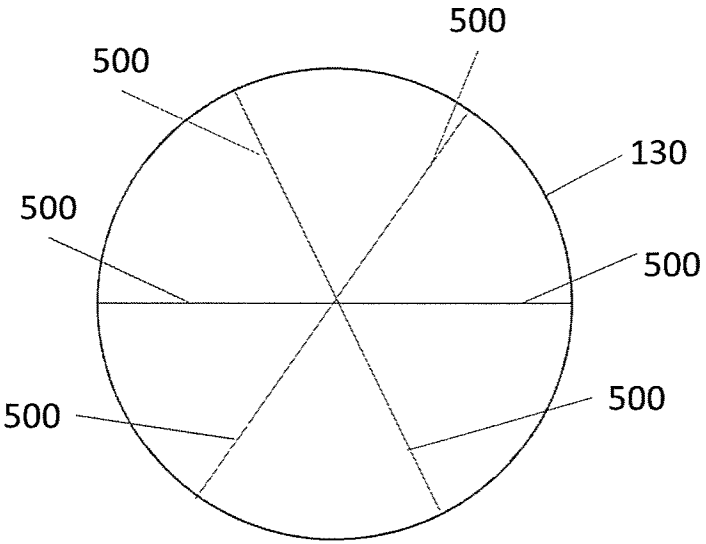
FIG. 5 shows an example diaphragm including example score marks.

The diaphragm 130 is typically made of metal, for example stainless steel or nickel. The diaphragm 130 may be scored across its surface to promote failure of the diaphragm 130 along predefined score lines as shown in FIG. 5. The score lines 500 may form a star pattern on the surface of the diaphragm 130, causing the diaphragm 130 to petal open along the predefined score lines. For example, six radial score lines may be provided, each starting at the top of the diaphragm 130 and ending at the circumference. The score lines may be equally spaced around the circumference of the diaphragm 130. It will be appreciated that the valve 200, including the diaphragm, pyrotechnic charge and device may be removable and/or replaceable as a single unit.

Figure 2:
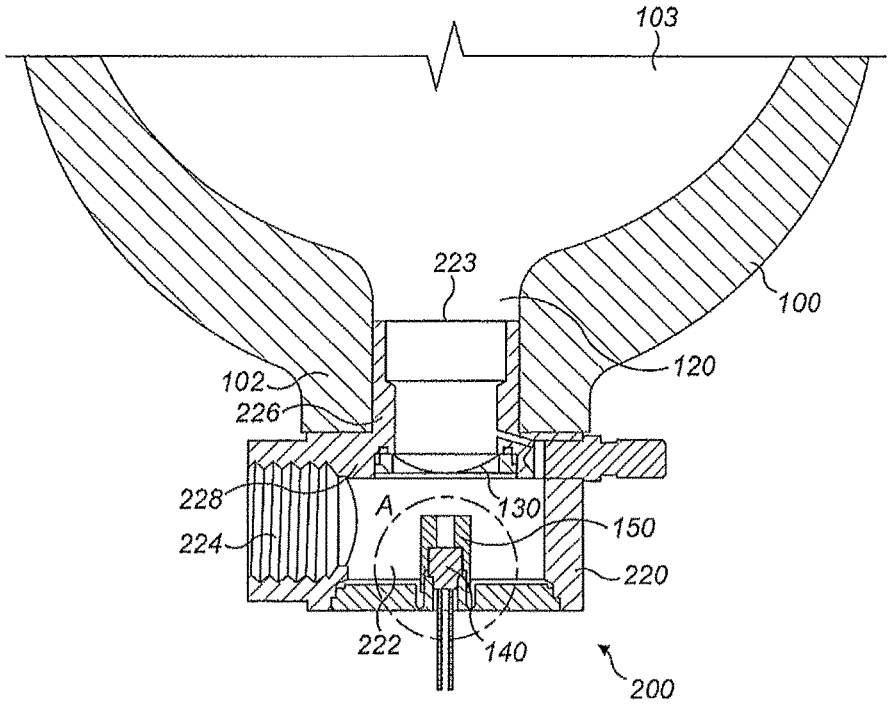
FIG. 2 shows an embodiment of the present disclosure.

As shown in FIG. 2 the diaphragm 130 is hemispherical and the tip of the hemisphere points towards the pyrotechnic charge 140, and away from the container 100 and chamber portion 103.

In accordance with the present disclosure, a device 150 is located over and/or around the pyrotechnic charge 140 so as to encase it, and is configured to focus the shockwave onto the centre of the diaphragm 130. It has been found that some pyrotechnic charges of the gaseous type (rather than the fragmenting type) have not been sufficient to cause the diaphragm 130 to open. Focusing the combustion products onto the centre of the diaphragm 130 using a device 150 as described herein maximises the energy applied to the diaphragm 130 by the combustion products, and decreases the energy lost to the environment, e.g. walls of the passage 222.

Figure 3A:
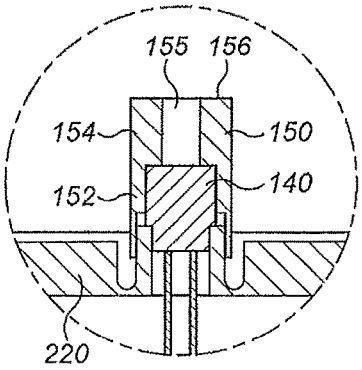
FIG. 3A shows an embodiment of the present disclosure.

FIG. 3A shows the pyrotechnic charge 140 and the device 150 in more detail.

The device 150 in the illustrated embodiment is in the form of a hollow tube or cylinder having a lower portion 152 and an upper portion 154.

The lower portion 152 is tubular and has a relatively large inner diameter. The pyrotechnic charge 140 is located within the lower portion 152 having the relatively large inner diameter. The pyrotechnic charge 140 may comprise a cap or cover. This means that a small portion of the energy produced by the pyrotechnic charge 140 may be required to rupture or break the cap or cover. However, such a cap or cover would optionally be distinct from the device 150 and its elongate channel 155. Other embodiments are contemplated in which the device forms the cap or cover for a combustible material, in which case the pyrotechnic charge may consist or, or consist essentially of a combustible material.

The upper portion 154 of the device 150 is also tubular and has a relatively small inner diameter so as to provide an elongate channel 155 for combustion products to pass through upon activation of the pyrotechnic charge. The elongate channel directs the combustion products onto the centre of the diaphragm 140. The elongate channel 155 has a length that is at least 1.5 times its diameter, and optionally at least 2, 3, 4 or 5 times its diameter.

The device is most effective when the charge is directed onto the centre of the diaphragm, since the centre is always the weakest part of the diaphragm when subjected to the internal pressure from the cylinder. Using a device 150, especially a device 150 comprising an elongate channel 155 as described herein, provides the optimum conditions for rupturing the diaphragm 130.

The device is most effective when the charge is directed onto the centre of the diaphragm, since the centre is typically the weakest part of the diaphragm when subjected to the internal pressure from the interior of the container 100. A device 150 comprising an elongate channel 155 as described herein provides the optimum conditions for rupturing the diaphragm 130 using a pyrotechnic charge.

Figure 1B:
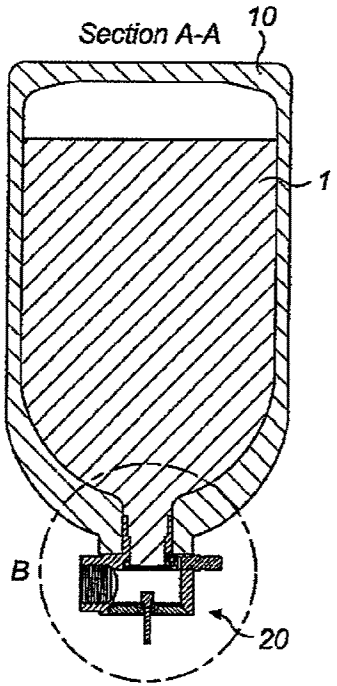
FIG. 1B PRIOR ART
Figure 1C:
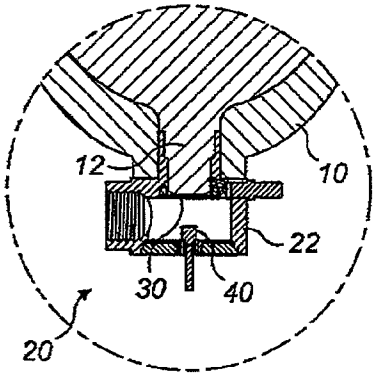
FIG. 1C PRIOR ART

The device 150 may reduce the energy requirements of a given pyrotechnic charge. For example, using the conventional arrangement of FIGS. 1A-1C, a given shockwave produced by a pyrotechnic charge may not transfer sufficient energy to the diaphragm 30 to open it. Using the arrangement of FIG. 2, the shockwave produced by the same pyrotechnic charge 140 will have the same energy, but it will be focused onto the centre of the diaphragm 130 by the device 150, and the diaphragm 130 will tear open, for example along the predefined score lines.

The device 150 is located a sufficient distance from the diaphragm 130 such that the diaphragm 130 can fully open upon activation of the pyrotechnic charge 140. For example, upon perforation of the diaphragm 130 it will petal open along the predefined score lines, and the tips of the petals will not clip or touch an end 156 of the device 150 as they travel past.

The device 150 does not substantially combust, fragment or break upon activation of the pyrotechnic charge 140. That is, the device 150 stays substantially intact upon activation of the pyrotechnic charge 140. The device 150 may be made of metal to achieve this, although other materials could be used, such as a ceramic.

Figure 3B:
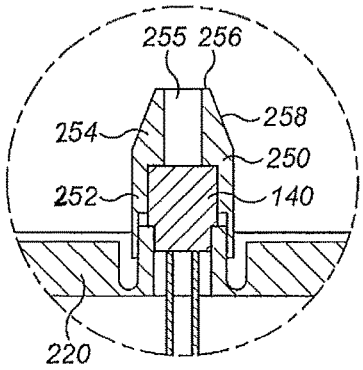
FIG. 3B shows a further embodiment of the present disclosure.

An alternative embodiment is shown in FIG. 3B. This embodiment is identical to that of FIGS. 2 and 3A, expect that a different device 250 is provided.

In this embodiment, the end 256 of the device 250 located towards the diaphragm 130 comprises a chamfered outer circumference 258, or "chamfer". This allows a minimum distance to be provided between the end 256 of the device 250 and the diaphragm 130, since the chamfer 258 allows more room for portions of the diaphragm 130, for example petals, to pass through when the diaphragm 130 is ruptured upon activation of the pyrotechnic charge.

With respect to the remaining features of the device 250, these are substantially the same as those of the device 150 of FIG. 3A and have been denoted with like reference numerals accordingly, but with 100 added to each number.

Although the present disclosure has been described with reference to specific embodiments, it will be understood by those skilled in the art that various changes in form and detail may be made without departing from the scope of the disclosure as set forth in the accompanying claims.

The invention claimed is:

1. A valve configured to plug and seal a pressurized container and for controlling the release of fire suppressant therefrom, said valve comprising:

a diaphragm configured to perforate upon action of a shockwave directed onto a surface of said diaphragm;

a pyrotechnic charge arranged and adapted to combust to produce combustion products that form a shockwave directed onto the surface of said diaphragm;

a device encasing said pyrotechnic charge and comprising a hollow, elongate channel located over said pyrotechnic charge and directed at a center of said diaphragm so as to focus or direct said combustion products onto the center of said diaphragm; and a passage for fire suppressant to travel through, wherein said passage extends from a valve inlet to a valve outlet, wherein upon perforation of said diaphragm fire suppressant travels through said passage from said valve inlet to said valve outlet, and said diaphragm, pyrotechnic charge and device are all located within said passage;

wherein said elongate channel has a length that is at least 1.5 times its smallest width;

wherein said diaphragm comprises a plurality of score lines that define portions of said diaphragm that will tear open upon action of a shockwave directed onto the surface of the diaphragm; and wherein said device comprises a hollow tube comprising the elongate channel and having an outlet end located at an end of the elongate channel located towards the diaphragm and away from the pyrotechnic charge, wherein the outlet end of the hollow tube is chamfered to prevent one of said portions of said diaphragm touching said tube upon opening.

2. A valve as claimed in claim 1, wherein said device is a single piece comprising a lower portion comprising a first diameter and holding the pyrotechnic charge, and an upper portion comprising said elongate channel, wherein said elongate channel comprises a second diameter, and the second diameter is smaller than the first diameter.

3. A valve as claimed in claim 1, wherein said diaphragm is configured to perforate such that portions of said diaphragm open outward and towards said pyrotechnic charge.

4. A valve as claimed in claim 1, wherein said pyrotechnic charge comprises a cap or cover enclosing a combustible material, wherein said cap or cover is separate to said device encasing said pyrotechnic charge.

5. A valve as claimed in claim 4, wherein said device is configured to stay intact upon activation of said pyrotechnic charge.

6. A valve as claimed in claim 1, wherein said device is metallic or ceramic.

7. A valve as claimed in claim 1, wherein said combustion products comprise primarily gaseous matter.

8. A valve as claimed in claim 1, wherein said combustion products do not comprise solid fragments of said pyrotechnic charge.

9. A valve as claimed in claim 1, wherein said diaphragm is located a distance from said pyrotechnic charge, wherein said distance is sufficient to allow portions of said diaphragm to open at least 45 degrees upon perforation thereof.

10. An apparatus comprising:

a pressurized chamber having fire suppressant therein and having an outlet;

a valve as claimed in claim 1, wherein said valve seals said outlet of said chamber so as to control the release of fire suppressant therefrom, wherein said valve inlet seals against the outlet of the pressurized chamber.

* * * * *